US012007125B2

(12) United States Patent
Luo

(10) Patent No.: US 12,007,125 B2
(45) Date of Patent: Jun. 11, 2024

(54) DEHUMIDIFIER

(71) Applicant: Guangzhou Talong Technology Co., Ltd., Guangzhou (CN)

(72) Inventor: Likang Luo, Guangzhou (CN)

(73) Assignee: GUANGZHOU TALONG TECHNOLOGY CO., LTD., Guangzhou (CN)

( * ) Notice: Subject to any disclaimer, the term of this patent is extended or adjusted under 35 U.S.C. 154(b) by 0 days.

(21) Appl. No.: 18/377,930

(22) Filed: Oct. 9, 2023

(65) Prior Publication Data

US 2024/0035676 A1 Feb. 1, 2024

(30) Foreign Application Priority Data

Sep. 6, 2023 (CN) ..... 202322427994.2

(51) Int. Cl.

| | |
|---|---|
| ***F24F 1/0083*** | (2019.01) |
| ***F24F 5/00*** | (2006.01) |
| ***F24F 11/52*** | (2018.01) |
| ***F24F 13/22*** | (2006.01) |
| ***F24F 140/30*** | (2018.01) |

(52) U.S. Cl.

CPC ..... *F24F 1/0083* (2019.02); *F24F 5/0042* (2013.01); *F24F 11/52* (2018.01); *F24F 13/222* (2013.01); *F24F 2140/30* (2018.01)

(58) Field of Classification Search

CPC . F25B 2321/02; F25B 21/02; F24F 2003/144; F24F 3/14; F24F 1/0358; F24F 1/0083; F24F 5/0042

See application file for complete search history.

(56) References Cited

U.S. PATENT DOCUMENTS

| | | | | |
|---|---|---|---|---|
| 2010/0154437 | A1* | 6/2010 | Nepsha | F24F 5/0042 62/3.4 |
| 2014/0306022 | A1* | 10/2014 | Simon | F24F 3/14 236/44 R |
| 2016/0243576 | A1* | 8/2016 | Young | A61L 9/14 |
| 2016/0305672 | A1 | 10/2016 | Jeon | |
| 2016/0334118 | A1 | 11/2016 | Ahn et al. | |
| 2019/0344215 | A1 | 11/2019 | Saeki et al. | |

FOREIGN PATENT DOCUMENTS

KR 20130015883 A * 2/2013

OTHER PUBLICATIONS

KR20130015883A Translation (Year: 2013).*

* cited by examiner

*Primary Examiner* — Schyler S Sanks
(74) *Attorney, Agent, or Firm* — Zhigang Ma

(57) ABSTRACT

The present disclosure provides a dehumidifier. The dehumidifier includes a shell, a dehumidifying device and a driving device. The shell is provided with an air inlet and an air outlet. The dehumidifying device is configured to dry and dehumidify introduced air. The driving device is configured to drive air to pass through the air inlet, the dehumidifying device and the air outlet in sequence, so that the driving device can drive the air with high moisture content to enter the shell through the air inlet and condense the water vapor in air into water drops under the action of the dehumidifying device, thereby achieving the dehumidification effect.

18 Claims, 8 Drawing Sheets

DEHUMIDIFIER

CROSS-REFERENCE TO RELATED APPLICATIONS

The application claims priority of Chinese patent application 2023224279942, filed on 2023 Sep. 6, which is incorporated herein by reference in its entireties.

TECHNICAL FIELD

The present utility model relates to the field of dehumidifiers, in particular to a dehumidifier.

BACKGROUND

In a humid environment, moisture may result in many problems, such as mold growth, metal corrosion, etc. Therefore, a dehumidifier, as a common household appliance, is widely used in homes, offices, warehouses and other places to control humidity in air and provide a more comfortable and healthy indoor environment. However, noise generated by a current dehumidifier during normal operation may interfere with rest and sleep. Therefore, it is necessary to provide a dehumidifier that can switch different modes to meet the different needs of users for daily dehumidification and quiet use at night.

SUMMARY

In order to overcome the shortcomings of the prior art, the present disclosure provides a dehumidifier, including:

- a shell, wherein the shell is provided with an air inlet and an air outlet;
- a dehumidifying device, wherein the dehumidifying device is configured to dry and dehumidify introduced air, and the dehumidifying device at least includes a first working mode and a second working mode;
- a driving device, wherein the driving device is configured to drive air to pass through the air inlet, the dehumidifying device and the air outlet in sequence;
- a switching device, wherein the switching device is configured to switch the dehumidifying device to the first working mode or the second working mode.

As the improvement of the present disclosure, the dehumidifier further includes a light-emitting device, the light-emitting device is capable of emitting lights with different colors, and the switching device is configured to control the light-emitting device to be ON and OFF and switch different colors of the lights.

As the improvement of the present disclosure, the switching device includes a first switching button, a second switching button and a third switching button, the first switching button is configured to control the dehumidifier to be ON and OFF and control the dehumidifying device to switch to the first working mode, the second switching button is configured to control the light-emitting device to be ON and OFF and switch different colors of lights, and the third switching button is configured to control the dehumidifying device to switch to the second working mode.

As the improvement of the present disclosure, the first working mode is a normal mode, when the dehumidifier is in the normal mode, the driving device and the dehumidifying device operate at a highest working speed, and the light-emitting device is in an on state or an off state; the second working mode is a sleep mode, when the dehumidifier is in the sleep mode, the driving device and the dehumidifying device operate at a lowest working speed, and the light-emitting device is in an off state.

As the improvement of the present disclosure, the dehumidifying device includes a radiating fin, a semiconductor cooling fin and a cooling guide fin, a hot end face of the semiconductor cooling fin clings to the radiating fin, and a cold end face of the semiconductor cooling fin clings to the cooling guide fin.

As the improvement of the present disclosure, a first installation shell and a second installation shell are installed inside the shell, the first installation shell and the second installation shell are detachably connected to form a first accommodating cavity, the radiating fin is placed in the first accommodating cavity, the first installation shell is provided with a cooling guide opening, the semiconductor cooling fin is installed at the cooling guide opening, and a cooling guide fin is installed outside the first installation shell, so that the radiating fin, the semiconductor cooling fin and the cooling guide fin are connected in sequence.

As the improvement of the present disclosure, the driving device includes a fan and a motor, the motor is electrically connected with the fan to drive the fan to rotate, the fan is installed outside the second installation shell, the second installation shell is provided with a ventilation opening, and the ventilation opening enables the radiating fin to be communicated with the fan.

As the improvement of the present disclosure, the dehumidifier further includes a water drainage mechanism, the water drainage mechanism is installed on the first installation shell and is located below the cooling guide fin, and the water drainage mechanism is configured to collect water drops condensed by the cooling guide fin and discharge the water drops out of the shell.

As the improvement of the present disclosure, the water drainage mechanism includes a water collection tank and a drainage channel located below the water collection tank, the water collection tank and the drainage channel are integrally formed, and an inner bottom surface of the water collection tank is depressed to form a V-shaped cross section.

As the improvement of the present disclosure, a separator is installed inside the shell, the separator is located below the dehumidifying device and the driving device, the separator is provided with a first through hole, and the drainage channel is connected with the first through hole.

As the improvement of the present disclosure, the dehumidifier further includes a water collection tank, the separator and an inner wall and a base of the shell surround to form a second accommodating cavity, the shell is provided with a placing opening, the water collection tank is placed into the second accommodating cavity through the placing opening, the water collection tank is provided with a first opening, and when the water collection tank is completely placed into the second accommodating cavity, the drainage channel, the first through hole and the first opening are communicated with each other in sequence.

As the improvement of the present disclosure, a floating plate is provided inside the water collection tank, a control switch is provided above a first end of the floating plate, the first end is in contact with the control switch to control the dehumidifier to be ON, and when a liquid level in the water collection tank rises to float a second end of the floating plate, the first end of the floating plate is separated from the control switch to turn off the dehumidifier.

As the improvement of the present disclosure, the water collection tank includes a cover and a box, the cover is provided with a first avoidance opening, the first end of the floating plate is hinged with a bottom of the cover, and a weight of the second end is greater than that of the first end, so that the first end is in contact with the control switch.

As the improvement of the present disclosure, the separator is provided with a second avoidance opening, the control switch is provided below the dehumidifying device and is located above the second avoidance opening, and the first avoidance opening is communicated with the second avoidance opening, so that the first end is in contact with the control switch.

As the improvement of the present disclosure, the light-emitting device is connected with the control switch, the separator is provided with a first light-transmitting opening, the cover is provided with a second light-transmitting opening, and the first light-transmitting opening and the second light-transmitting opening are located below the light-emitting device in sequence to allow light of the light-emitting device to pass through.

As the improvement of the present disclosure, a front side of the shell is provided with a water observation opening, the water collection tank is a transparent water collection tank, and both the water observation opening and the water collection tank are capable of observing a liquid level height of condensed water in the water collection tank and are capable of observing light emitted by the light-emitting device.

As the improvement of the present disclosure, the light-emitting device includes an LED lamp, and the LED lamp is capable of emitting light of at least seven colors.

As the improvement of the present disclosure, the air inlet is located at a rear side of the shell and is provided opposite to the cooling guide fin, and the air outlet is located at both sides of the shell.

As the improvement of the present disclosure, the dehumidifier further includes an energy storage power supply, wherein the energy storage power supply is electrically connected with the dehumidifying device, the driving device and the light-emitting device to provide power support.

As the improvement of the present disclosure, a rear side of the shell is provided with a first handle groove, a bottom of the water collection tank is provided with a second handle groove; the switch device is located at a front side of the shell, the switch device includes a touch display panel, and the first switching button, the second switching button and the third switching button are all touch buttons and are provided on the touch display panel.

Beneficial effects: the present disclosure provides a dehumidifier including a shell, the shell is provided with an air inlet and an air outlet. a dehumidifying device, the dehumidifying device is configured to dry and dehumidify introduced air. a driving device, the driving device is configured to drive air to pass through the air inlet, the dehumidifying device and the air outlet in sequence, so that the driving device can drive the air with high moisture content to enter the shell through the air inlet and condense the water vapor in air into water drops under the action of the dehumidifying device, thereby achieving the dehumidification effect. As the dehumidifying device includes a first working mode and a second working mode, the dehumidifier includes a switching device, which is configured to switch the dehumidifying device to the first working mode or the second working mode, so that users can switch to the appropriate working mode through the switching device according to actual needs, so as to obtain the best dehumidifying effect in different use situations. This customized design considers the needs of users in comfort, energy efficiency and environmental noise, and improves the practicability and user experience of products.

BRIEF DESCRIPTION OF THE DRAWINGS

In order to explain the technical solutions of the embodiments of the present disclosure more clearly, the following will briefly introduce the accompanying drawings used in the embodiments. The drawings in the following description are only some embodiments of the present disclosure. Those of ordinary skill in the art can obtain other drawings based on these drawings without creative work.

The present disclosure is further described below in detail in combination with the accompanying drawings and embodiments.

DETAILED DESCRIPTION OF THE EMBODIMENTS

Figure 1:
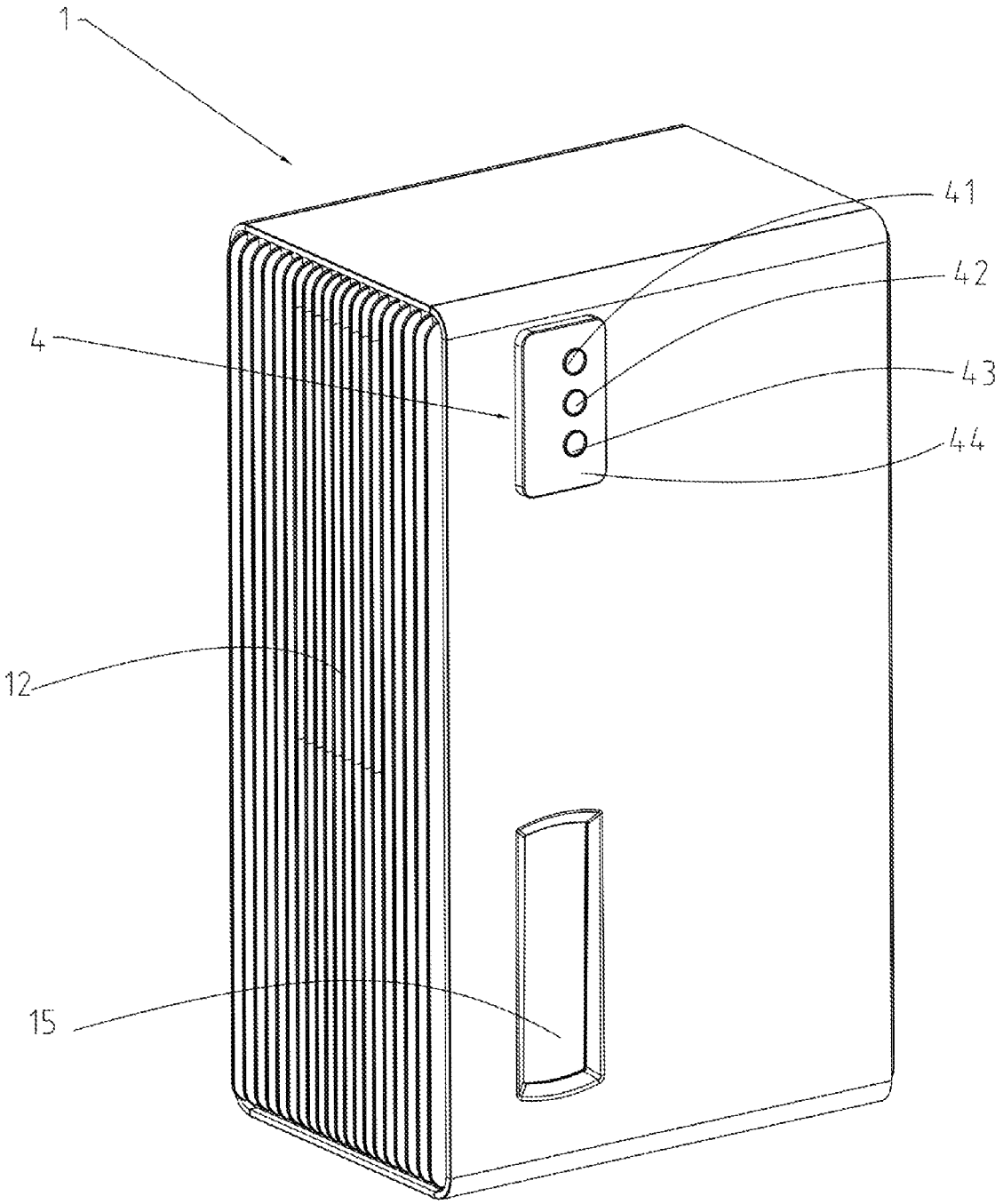
FIG. 1 is a schematic diagram of an overall structure of the present utility model.
Figure 2:
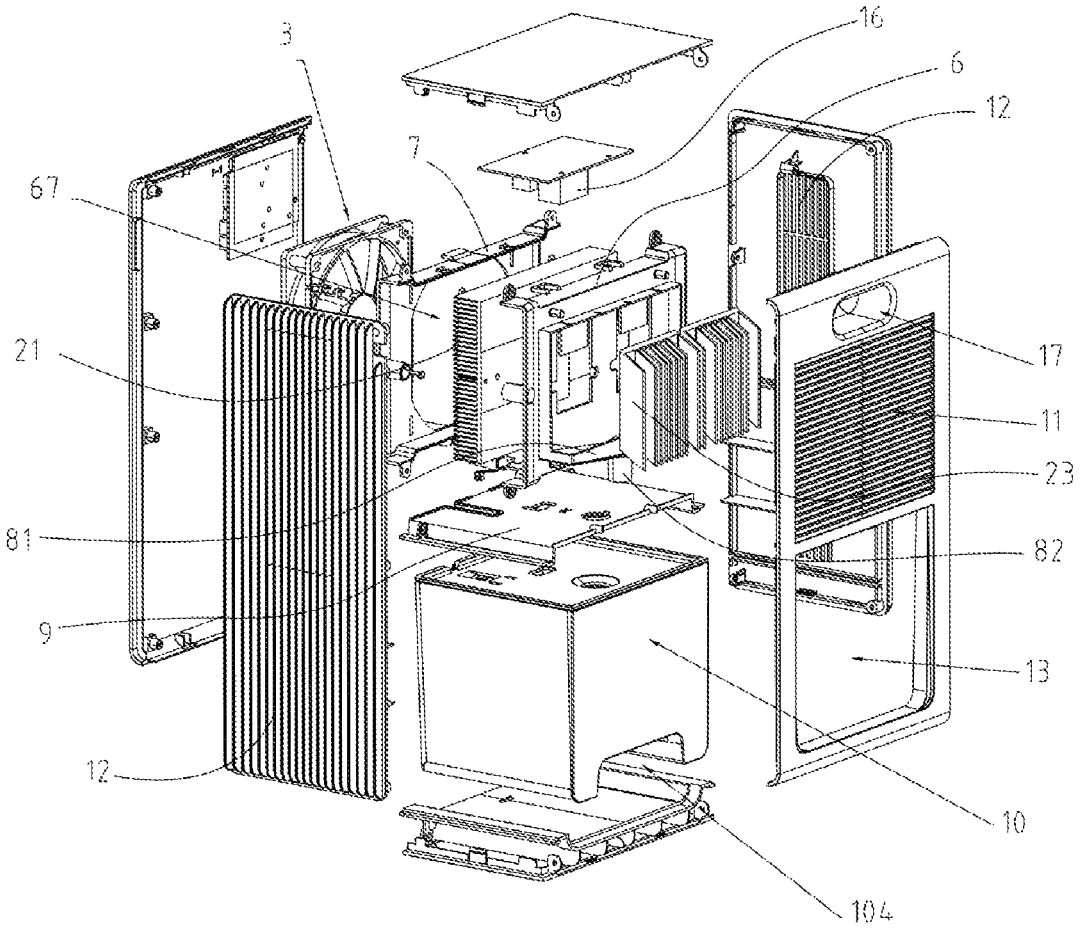
FIG. 2 is an exploded diagram of the present utility model.
Figure 3:
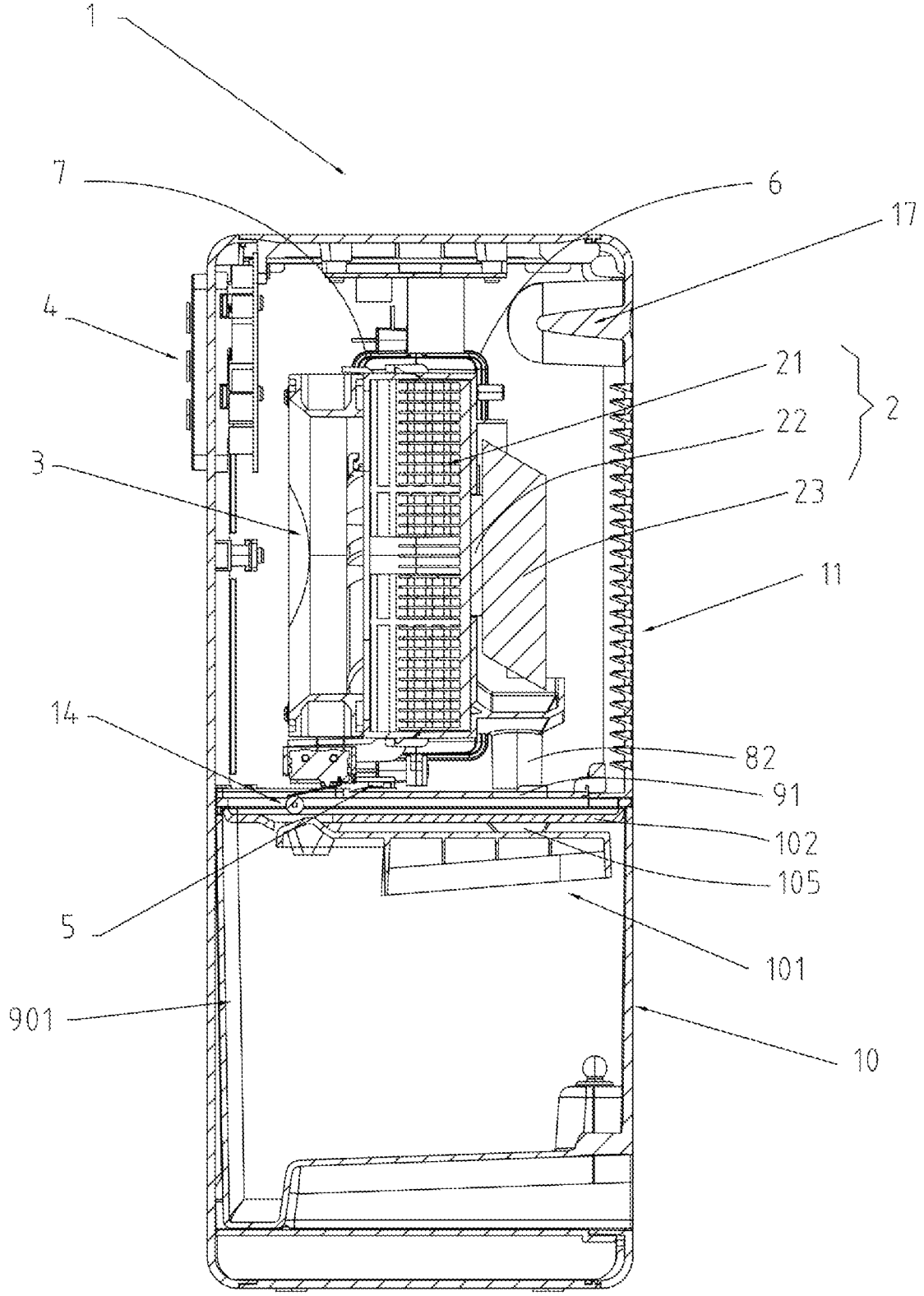
FIG. 3 is a cross-sectional diagram of the present utility model.
Figure 4:
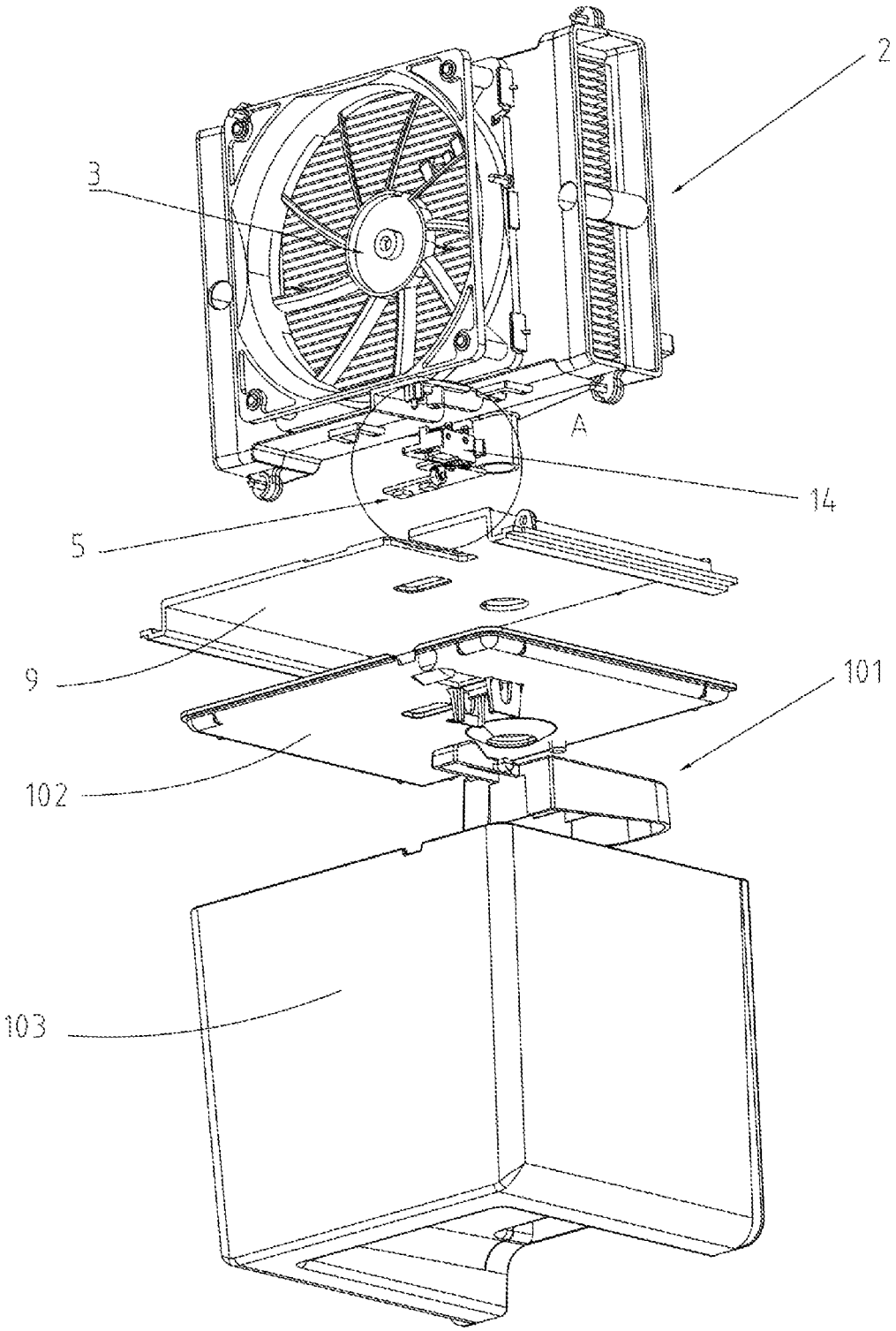
FIG. 4 is another exploded diagram of the present utility model.
Figure 5:
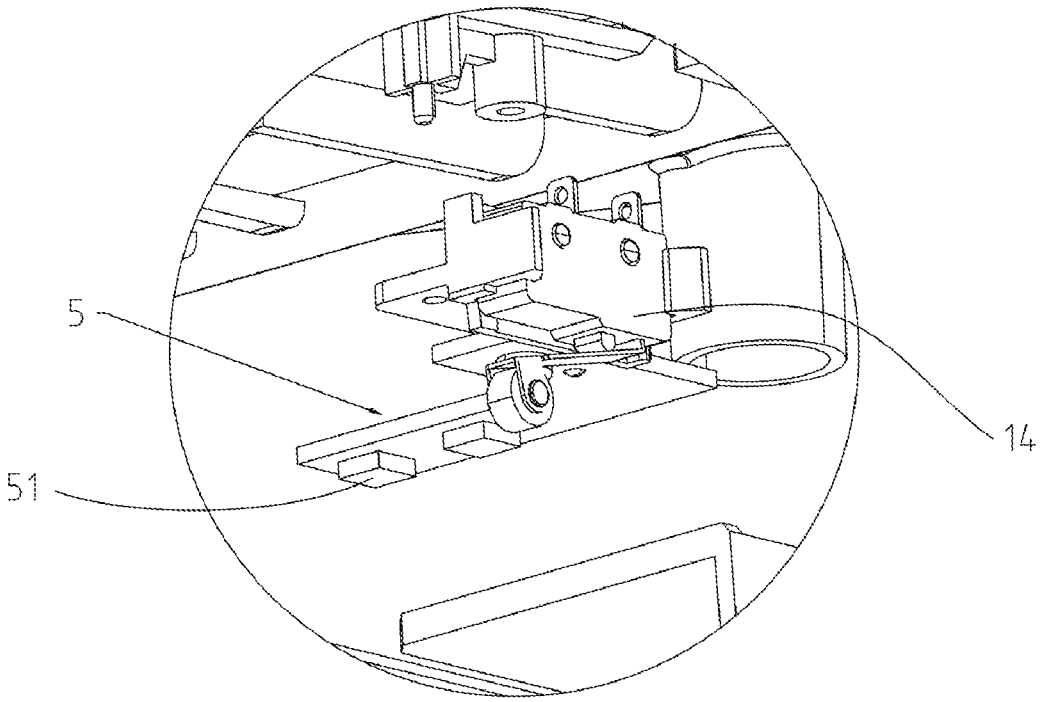
FIG. 5 is an enlarged diagram at FIG. 4A.
Figure 6:
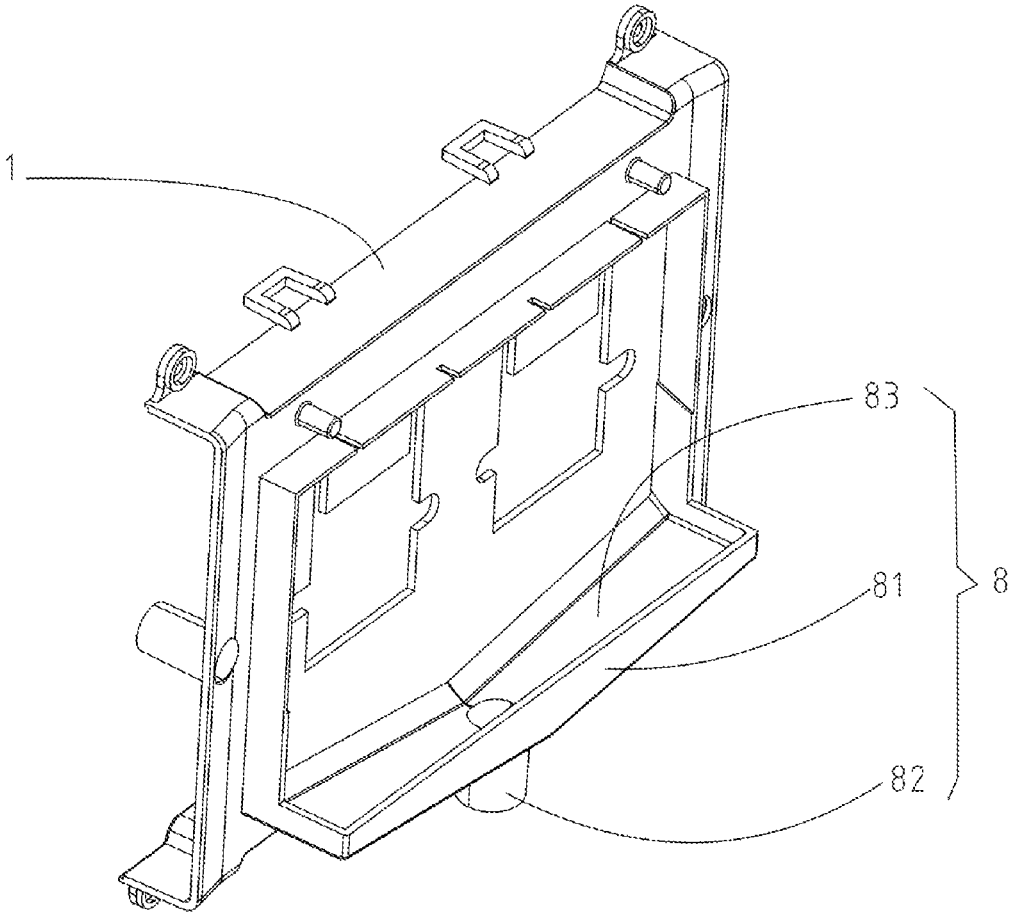
FIG. 6 is a schematic structural diagram of a water drainage mechanism according to the present utility model.
Figure 7:
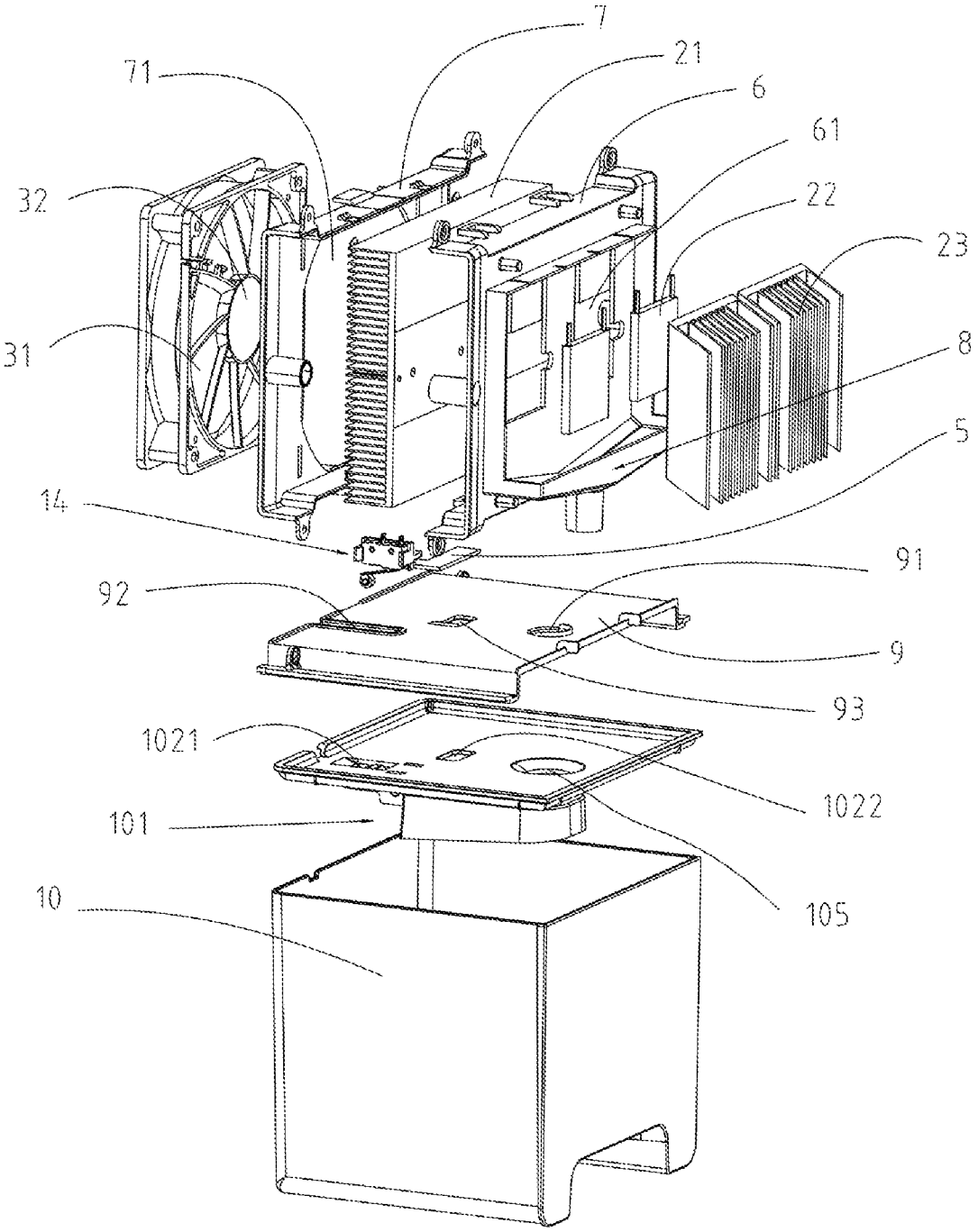
FIG. 7 is another exploded diagram of the present utility model.
Figure 8:
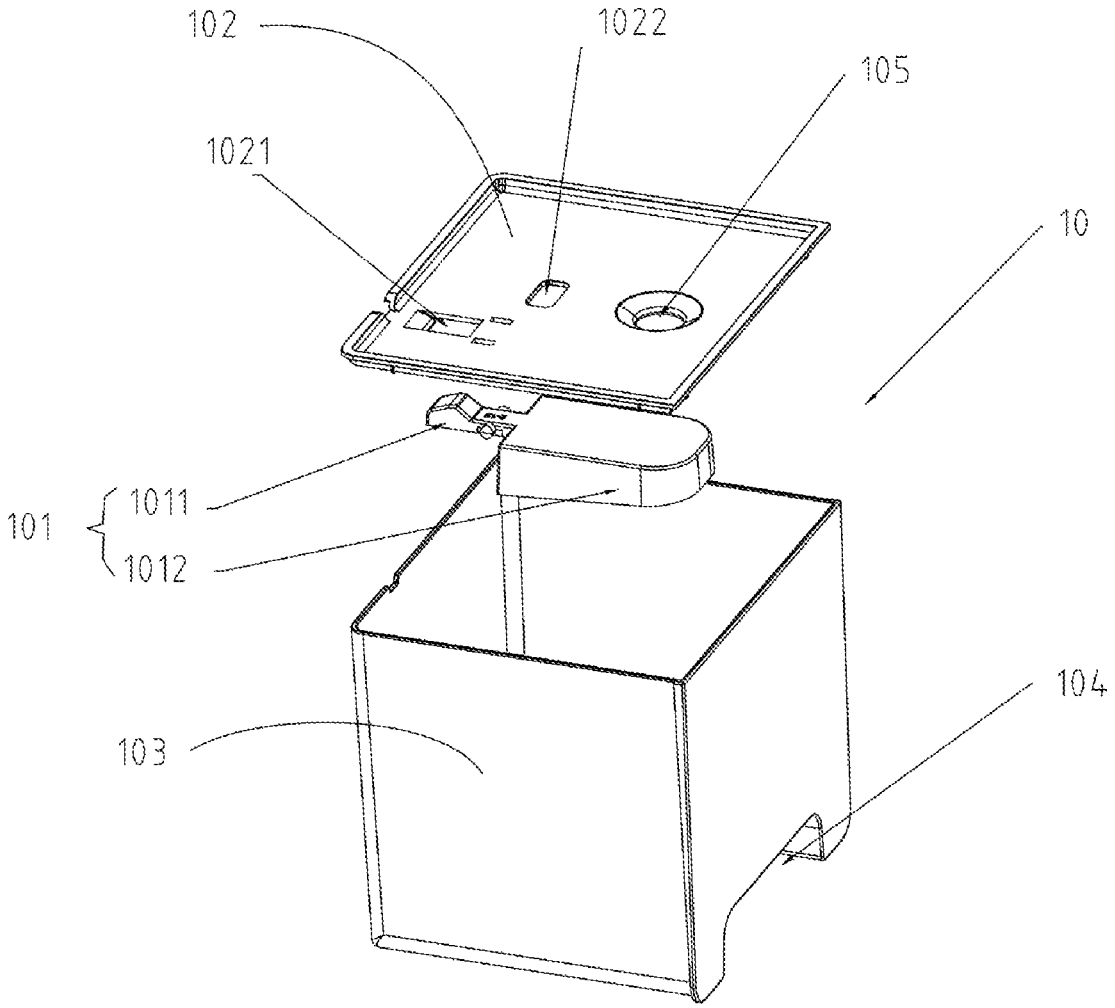
FIG. 8 is an exploded diagram of a water collection tank according to the present utility model.

As shown in FIGS. 1 to 5, a dehumidifier includes: a shell 1, wherein the shell 1 is provided with an air inlet 11 and an air outlet 12; a dehumidifying device 2, wherein the dehumidifying device 2 is configured to dry and dehumidify introduced air, and the dehumidifying device 2 at least includes a first working mode and a second working mode; a driving device 3, wherein the driving device 3 is configured to drive air to pass through the air inlet 11, the dehumidifying device 2 and the air outlet 12 in sequence; a switching device 4, wherein the switching device 4 is configured to switch the dehumidifying device 2 to the first working mode or the second working mode. With the above structure which includes the shell, the shell is provided with an air inlet and an air outlet. The dehumidifying device is configured to dry and dehumidify introduced air. The driving device is configured to drive air to pass through the air inlet, the dehumidifying device and the air outlet in sequence, so that the driving device can drive the air with high moisture content to enter the shell through the air inlet and condense the water vapor in air into water drops under the action of the dehumidifying device, thereby achieving the dehumidification effect. As the dehumidifying device includes a first working mode and a second working mode, the dehumidifier includes a switching device, which is configured to switch the dehumidifying device to the first working mode or the second working mode, so that users can switch to the appropriate working mode through the switching device according to actual needs, so as to obtain the best dehumidifying effect in different use situations. This customized design considers the needs of users in comfort, energy efficiency and environmental noise, and improves the practicability and user experience of products.

In this embodiment, the dehumidifier further includes a light-emitting device 5, the light-emitting device 5 is capable of emitting lights with different colors, and the switching device 4 is configured to control the light-emitting device 5 to be ON and OFF and switch different colors of the lights. Specifically, the light-emitting device is an LED lamp, and the LED lamp can emit at least seven colors of light. With the above structure, the light-emitting device can be used as an atmosphere lamp, and users can choose appropriate lighting settings according to different situations and moods, so as to use the dehumidifier individually. The light-emitting device can also provide night navigation. If the dehumidifier is placed in a bedroom or other places that need night navigation, a soft atmosphere lamp can provide enough illumination in the dark to help users move safely at night.

In this embodiment, the switching device 4 includes a first switching button 41, a second switching button 42 and a third switching button 43, the first switching button 41 is configured to control the dehumidifier to be ON and OFF and control the dehumidifying device 2 to switch to the first working mode, the second switching button 42 is configured to control the light-emitting device 5 to be ON and OFF and switch different colors of lights, and the third switching button 43 is configured to control the dehumidifying device 2 to switch to the second working mode. Specifically, when the first switching button is pressed, the dehumidifier is turned on while the first working mode is started, and when the first switching button is pressed again, the dehumidifier is turned off. In the case of starting the dehumidifier, when the second switching button is pressed, the light-emitting device is turned on and various colors are changing automatically. When the user wants to select a certain color, he can press the second switching button again to select the light-emitting color, and the light-emitting device is turned off after pressing the second switching button again. In the case of starting the dehumidifier, when the third switching button is pressed, the dehumidifier is in the second working state, and the second working state of the dehumidifier can be closed by pressing the third switching button again. With the above structure, the switching of different modes of the dehumidifier is effectively realized, which is convenient for users to operate.

In this embodiment, the first working mode is a normal mode, when the dehumidifier is in the normal mode, the driving device 3 and the dehumidifying device 2 operate at a highest working speed, and the light-emitting device 5 is in an on state or an off state; the second working mode is a sleep mode, when the dehumidifier is in the sleep mode, the driving device 3 and the dehumidifying device 2 operate at a lowest working speed, and the light-emitting device 5 is in an off state. Specifically, when the dehumidifier is in the normal mode, the indoor humidity can be quickly reduced, and the light-emitting device emits light normally. When the dehumidifier is in the sleep mode, the working speed slows down, and the power consumption is reduced, thus achieving the purpose of energy saving, and providing a comfortable environment while reducing the power consumption. With the above structure, this customized design considers the needs of users in comfort, energy efficiency and environmental noise, and improves the practicality of products and user experience.

In this embodiment, the dehumidifying device 2 includes a radiating fin 21, a semiconductor cooling fin 22 and a cooling guide fin 23, a hot end face of the semiconductor cooling fin 22 clings to the radiating fin 21, and a cold end face of the semiconductor cooling fin 22 clings to the cooling guide fin 23. With the above structure, the semiconductor cooling fin can absorb heat and reduce the temperature of the hot end, thus causing water vapor in the wet air to condense into liquid water. Such structural design is relatively compact and efficient.

In this embodiment, a first installation shell 6 and a second installation shell 7 are installed inside the shell 1, the first installation shell 6 and the second installation shell 7 are detachably connected to form a first accommodating cavity 67, the radiating fin is placed in the first accommodating cavity 67, the first installation shell 6 is provided with a cooling guide opening 61, the semiconductor cooling fin 22 is installed at the cooling guide opening 61, and a cooling guide fin 23 is installed outside the first installation shell 6, so that the radiating fin 21, the semiconductor cooling fin 22 and the cooling guide fin 23 are connected in sequence. With the above structure, the first installation shell and the second installation shell can keep the radiating fin, the semiconductor cooling fin and the cooling guide fin in safe and correct installation positions, and the structural design is compact and practical.

In this embodiment, the driving device 3 includes a fan 31 and a motor 32, the motor 32 is electrically connected with the fan 31 to drive the fan 31 to rotate, the fan 31 is installed outside the second installation shell 7, the second installation shell 7 is provided with a ventilation opening 71, and the ventilation opening 71 enables the radiating fin 21 to be communicated with the fan 31. With the above structure, because the second installation shell is provided with the ventilation opening, the fan not only can increase the condensation speed of water vapor, speed up the dehumidification process and improve the efficiency of the dehumidifier, but also help to release the treated dry air back to the cavity evenly, which can improve the consistency of indoor humidity and ensure that the whole space can benefit from the dehumidification effect.

In this embodiment, the dehumidifier further includes a water drainage mechanism 8, the water drainage mechanism 8 is installed on the first installation shell 6 and is located below the cooling guide fin 23, and the water drainage mechanism 8 is configured to collect water drops condensed by the cooling guide fin 23 and discharge the water drops out of the shell 1. Specifically, the water drainage mechanism 8 includes a water collection tank 81 and a drainage channel 82 located below the water collection tank 81, the water collection tank 81 and the drainage channel 82 are integrally formed, and an inner bottom surface of the water collection tank 81 is depressed to form a V-shaped cross section 83. With the above structure, the water drainage mechanism is located on the first installation shell and is located below the cooling guide fin, so that water drops can be prevented from scattering on other parts or the ground to the greatest extent, and moisture can be effectively collected and treated. The structure of the water collection tank and the drainage channel reduces the risk of water drops scattering to other areas, thus reducing the possible water leakage caused by the device. The V-shaped cross-section design can effectively guide the flow of water, prevent water from accumulating in the water collection tank, and reduce the potential problems caused by accumulated water. These designs can help maintain the operation stability and reliability of the device, thus prolonging its service life.

In this embodiment, a separator 9 is installed inside the shell 1, the separator 9 is located below the dehumidifying device 2 and the driving device 3, the separator 9 is provided with a first through hole 91, and the drainage channel 82 is connected with the first through hole 91. The dehumidifier further includes a water collection tank 10, the separator 9 and an inner wall and a base of the shell 1 surround to form a second accommodating cavity 901, the shell 1 is provided with a placing opening 13, the water collection tank 10 is placed into the second accommodating cavity 901 through the placing opening 13, the water collection tank 10 is provided with a first opening 105, and when the water collection tank 10 is completely placed into the second accommodating cavity 901, the drainage channel 82, the first through hole 91 and the first opening 105 are communicated with each other in sequence. With the above structure, the water collection tank is provided with the first opening. When the water collection tank is completely placed into the second accommodating cavity 901, the drainage channel, the first through hole and the first opening are communicated with each other in sequence. This design ensures that liquid can smoothly flow into the water collection tank from the drainage channel, so that condensate can be collected and discharged more quickly and efficiently, and the risk of water accumulation and water leakage is reduced.

In this embodiment, a floating plate 101 is provided inside the water collection tank 10, a control switch 14 is provided above a first end 1011 of the floating plate 101, the first end 1011 is in contact with the control switch 14 to control the dehumidifier to be ON, and when a liquid level in the water collection tank 10 rises to float a second end 1012 of the floating plate 101, the first end 1011 of the floating plate 101 is separated from the control switch 14 to turn off the dehumidifier. With the above structure, the control switch 14 is a micro switch. Under normal conditions, that is, when the second end 1012 of the floating plate 101 does not float upward, the first end 1011 of the floating plate 101 can touch the control switch 14 to turn on the dehumidifier. When the condensed water level rises, the second end of the floating plate 101 can float upward, so that the first end of the floating plate 101 can be separated from the control switch 14 to turn off the dehumidifier, thereby effectively realizing automatic turn-off of the dehumidifier when the condensed water is full. The design is simple and ingenious.

In this embodiment, the water collection tank 10 includes a cover 102 and a box 103, the cover 102 is provided with a first avoidance opening 1021, the first end 1011 of the floating plate 101 is hinged with a bottom of the cover 102, and a weight of the second end 1012 is greater than that of the first end 1011, so that the first end 1011 rises and passes through the first avoidance opening 1021 to be in contact with the control switch 14. The separator 9 is provided with a second avoidance opening 92, the control switch 14 is provided below the dehumidifying device 2 and is located above the second avoidance opening 92, and the first avoidance opening 1021 is communicated with the second avoidance opening 92, so that the first end 1011 is in contact with the control switch 14. With the above structure, the design of the first avoidance opening 1021 and the second avoidance opening 92 enables the first end 1011 of the floating plate 101 to be in contact with the control switch 14 smoothly, thus effectively realizing the function of automatically turning off the dehumidifier when the condensed water is full.

In this embodiment, the light-emitting device 5 is connected with the control switch 14, the separator 9 is provided with a first light-transmitting opening 93, the cover 102 is provided with a second light-transmitting opening 1022, and the first light-transmitting opening 93 and the second light-transmitting opening 1022 are located below the light-emitting device 5 in sequence to allow light of the light-emitting device 5 to pass through. A front side of the shell 1 is provided with a water observation opening 15, the water collection tank 10 is a transparent water collection tank, and both the water observation opening 15 and the water collection tank 10 are capable of observing a liquid level height of condensed water in the water collection tank 10 and are capable of observing light emitted by the light-emitting device 5. With the above structure, the first light-transmitting opening 93 and the second light-transmitting opening 1022 are provided, so that the light emitted by the light-emitting device 5 penetrates through the first light-emitting port 93 and the second light-emitting port 1022. Moreover, the light of different colors emitted by the light-emitting device 5 can be transmitted through the water collection tank because the water collection tank is a transparent water collection tank and the front side of the shell 1 is provided with the water observation opening 15, thus achieving the effect of making the dehumidifier realize an atmosphere lamp. Moreover, users can observe the liquid level height of condensed water in the water collection tank from the front or back of the dehumidifier shell, which is convenient for users to clean and dump the condensed water in the water collection tank in time.

In this embodiment, the light-emitting device 5 includes an LED lamp 51, and the LED lamp 51 is capable of emitting light of at least seven colors. Seven colors can be red, orange, yellow, green, blue, green, purple, etc., and various colors can meet different needs of users.

In this embodiment, the air inlet 11 is located at a rear side of the shell 1 and is provided opposite to the cooling guide fin 23, and the air outlet 12 is located at both sides of the shell 1. With the above structure, the air inlet 11 are provided opposite to the cooling guide fin 23, which facilitates air to enter and dehumidify, and increases the dehumidification efficiency. The number of the air outlets 12 is greater than that of the air inlets 11, so that air can be stably discharged, and the air speed will not be too fast. In addition, compared with the case of being provided at a front side, the air outlets 12 are provided at both sides, the wind can be prevented from blowing on people.

In this embodiment, the dehumidifier further includes an energy storage power supply 16, wherein the energy storage power supply 16 is electrically connected with the dehumidifying device 2, the driving device 3 and the light-emitting device 5 to provide power support. With the above structure, the design of the energy storage power supply 16 ensures the normal operation of the dehumidifier.

In this embodiment, a rear side of the shell 1 is provided with a first handle groove 17, a bottom of the water collection tank 10 is provided with a second handle groove 104; the switch device 4 is located at a front side of the shell 1, the switch device 4 includes a touch display panel 44, and the first switching button 41, the second switching button 42 and the third switching button 43 are all touch buttons and are provided on the touch display panel 44. With the above structure, it is convenient for users to move the dehumidifier at any time because the first handle groove 17 is provided. It is convenient for users to take the water collection tank and clean the condensate in the water collection tank at any time because the first handle groove 17 is provided. The shell is provided with a touch display panel 44, and the switching buttons are all touch buttons, so that the buttons are easy to clean and dustproof, concise and exquisite, and the appearance grade of the dehumidifier is increased.

One or more implementation modes are provided above in combination with specific contents, and it is not deemed that the specific implementation of the present disclosure is limited to these specifications. Any technical deductions or replacements approximate or similar to the method and structure of the present disclosure or made under the concept of the present disclosure shall fall within the scope of protection of the present disclosure.

What is claimed is:

1. A dehumidifier, comprising:

a shell, wherein the shell is provided with an air inlet and an air outlet;

a dehumidifying device, wherein the dehumidifying device is configured to dry and dehumidify introduced air, and the dehumidifying device at least comprises a first working mode and a second working mode;

a driving device, wherein the driving device is configured to drive air to pass through the air inlet, the dehumidifying device and the air outlet in sequence;

a switching device, wherein the switching device is configured to switch the dehumidifying device to the first working mode or the second working mode;

a light-emitting device, wherein the light-emitting device is capable of emitting lights with different colors, and the switching device is configured to control the light-emitting device to be ON and OFF and switch different colors of the lights;

wherein the switching device comprises a first switching button, a second switching button and a third switching button, the first switching button is configured to control the dehumidifier to be ON and OFF and control the dehumidifying device to switch to the first working mode, the second switching button is configured to control the light-emitting device to be ON and OFF and switch different colors of lights, and the third switching button is configured to control the dehumidifying device to switch to the second working mode.

2. The dehumidifier according to claim 1, wherein the first working mode is a normal mode, when the dehumidifier is in the normal mode, the driving device and the dehumidifying device operate at a highest working speed, and the light-emitting device is in an on state or an off state; the second working mode is a sleep mode, when the dehumidifier is in the sleep mode, the driving device and the dehumidifying device operate at a lowest working speed, and the light-emitting device is in an off state.

3. The dehumidifier according to claim 1, wherein the dehumidifying device comprises a radiating fin, a semiconductor cooling fin and a cooling guide fin, a hot end face of the semiconductor cooling fin clings to the radiating fin, and a cold end face of the semiconductor cooling fin clings to the cooling guide fin.

4. The dehumidifier according to claim 3, wherein a first installation shell and a second installation shell are installed inside the shell, the first installation shell and the second installation shell are detachably connected to form a first accommodating cavity, the radiating fin is placed in the first accommodating cavity, the first installation shell is provided with a cooling guide opening, the semiconductor cooling fin is installed at the cooling guide opening, and a cooling guide fin is installed outside the first installation shell, so that the radiating fin, the semiconductor cooling fin and the cooling guide fin are connected in sequence.

5. The dehumidifier according to claim 4, wherein the driving device comprises a fan and a motor, the motor is electrically connected with the fan to drive the fan to rotate, the fan is installed outside the second installation shell, the second installation shell is provided with a ventilation opening, and the ventilation opening enables the radiating fin to be communicated with the fan.

6. The dehumidifier according to claim 4, wherein the dehumidifier further comprises a water drainage mechanism, the water drainage mechanism is installed on the first installation shell and is located below the cooling guide fin, and the water drainage mechanism is configured to collect water drops condensed by the cooling guide fin and discharge the water drops out of the shell.

7. The dehumidifier according to claim 6, wherein the water drainage mechanism comprises a water collection tank and a drainage channel located below the water collection tank, the water collection tank and the drainage channel are integrally formed, and an inner bottom surface of the water collection tank is depressed to form a V-shaped cross section.

8. The dehumidifier according to claim 6, wherein a separator is installed inside the shell, the separator is located below the dehumidifying device and the driving device, the separator is provided with a first through hole, and the drainage channel is connected with the first through hole.

9. The dehumidifier according to claim 8, wherein the dehumidifier further comprises a water collection tank, the separator and an inner wall and a base of the shell surround to form a second accommodating cavity, the shell is provided with a placing opening, the water collection tank is placed into the second accommodating cavity through the placing opening, the water collection tank is provided with a first opening, and when the water collection tank is completely placed into the second accommodating cavity, the drainage channel, the first through hole and the first opening are communicated with each other in sequence.

10. The dehumidifier according to claim 9, wherein a floating plate is provided inside the water collection tank, a control switch is provided above a first end of the floating plate, the first end is in contact with the control switch to control the dehumidifier to be ON, and when a liquid level in the water collection tank rises to float a second end of the floating plate, the first end of the floating plate is separated from the control switch to turn off the dehumidifier.

11. The dehumidifier according to claim 10, wherein the water collection tank comprises a cover and a box, the cover is provided with a first avoidance opening, the first end of the floating plate is hinged with a bottom of the cover, and a weight of the second end is greater than that of the first end, so that the first end is in contact with the control switch.

12. The dehumidifier according to claim 10, wherein the separator is provided with a second avoidance opening, the control switch is provided below the dehumidifying device and is located above the second avoidance opening, and the first avoidance opening is communicated with the second avoidance opening, so that the first end is in contact with the control switch.

13. The dehumidifier according to claim 11, wherein the light-emitting device is connected with the control switch, the separator is provided with a first light-transmitting opening, the cover is provided with a second light-transmitting opening, and the first light-transmitting opening and the second light-transmitting opening are located below the light-emitting device in sequence to allow light of the light-emitting device to pass through.

14. The dehumidifier according to claim 12, wherein a front side of the shell is provided with a water observation opening, the water collection tank is a transparent water collection tank, and both the water observation opening and the water collection tank are capable of observing a liquid level height of condensed water in the water collection tank and are capable of observing light emitted by the light-emitting device.

15. The dehumidifier according to claim 13, wherein the light-emitting device comprises an LED lamp, and the LED lamp is capable of emitting light of at least seven colors.

16. The dehumidifier according to claim 13, wherein the air inlet is located at a rear side of the shell and is provided opposite to the cooling guide fin, and the air outlet is located at both sides of the shell.

17. The dehumidifier according to claim 13, further comprising an energy storage power supply, wherein the energy storage power supply is electrically connected with the dehumidifying device, the driving device and the light-emitting device to provide power support.

18. The dehumidifier according to claim 13, wherein a rear side of the shell is provided with a first handle groove, a bottom of the water collection tank is provided with a second handle groove; the switch device is located at a front side of the shell, the switch device comprises a touch display panel, and the first switching button, the second switching button and the third switching button are all touch buttons and are provided on the touch display panel.

* * * * *